US005887322A

United States Patent [19]

Hartzheim et al.

[11] Patent Number: 5,887,322

[45] Date of Patent: Mar. 30, 1999

[54] APPARATUS FOR SPLICING THREADLINES

[75] Inventors: Richard John Hartzheim, Sheboygan; David Reinhold Roland, Winneconne; Thomas Wilford Teerlink, Waynesboro, all of Wis.

[73] Assignee: E. I. du Pont de Nemours and Company, Wilmington, Del.

[21] Appl. No.: 53,804

[22] Filed: Apr. 2, 1998

[51] Int. Cl.[6] ..... B65H 69/02

[52] U.S. Cl. ..... 28/209; 28/141; 242/556.1

[58] Field of Search ..... 28/141, 172.1, 28/201, 202, 209, 299; 57/22, 23, 362, 1 UN; 242/556, 556.1; 156/504, 505, 506, 508, 509, 433, 434, 350

[56] References Cited

U.S. PATENT DOCUMENTS

| | | | |
|---|---|---|---|
| 3,668,852 | 6/1972 | Fusco et al. | 57/22 |
| 3,690,994 | 9/1972 | Williams | 156/433 |
| 3,923,588 | 12/1975 | Warthen | 156/502 |
| 4,998,566 | 3/1991 | Akiyama | 139/35 |
| 5,152,130 | 10/1992 | McGrew | 57/23 |
| 5,518,202 | 5/1996 | Focke et al. | 242/556.1 |
| 5,698,060 | 12/1997 | Long | 242/556.1 |
| 5,709,355 | 1/1998 | Kinnunen et al. | 242/556.1 |

FOREIGN PATENT DOCUMENTS

| | | | |
|---|---|---|---|
| 33 36 202 A1 | 5/1983 | Germany | B65H 69/00 |
| PCT/US97/02494 | 7/1997 | WIPO | B65H 69/06 |

*Primary Examiner*—Michael A. Neas
*Assistant Examiner*—Larry O. Worrell, Jr.
*Attorney, Agent, or Firm*—George A. Frank

[57] ABSTRACT

An apparatus and method for splicing a moving threadline to a stationary threadline utilizing adhesive tapes is provided.

6 Claims, 3 Drawing Sheets

APPARATUS FOR SPLICING THREADLINES

BACKGROUND OF THE INVENTION

1. Field of the Invention

This invention relates to an apparatus and a method for splicing threadlines and, more specifically, to such apparatus and method permitting splicing without stopping the moving threadline in order to perform the splicing operation.

2. Description of Background Art

It would be advantageous when using threadlines in knitting or weaving to have a continuous source of the fiber, yarn, or filament that make up the threadline so that the downstream process using the a threadline can be operated without stopping. However, all such threadlines are shipped in discrete packages, and connecting the end of one package to the beginning of the next package becomes necessary.

U.S. Pat. No. 3,668,852 discloses an apparatus for automatically wrapping a splicing filament around the yarns to be spliced. U.S. Pat. Nos. 3,923,588 and 3,690,994 describe devices for thermally splicing thermoplastic yarns. All of the devices disclosed above require that the moving threadline be stopped in order to perform the splicing manipulation.

International Patent Application No. PCT/US97/02494 discloses pressing and heat fusing two yarns which are placed in a crossing position which avoids having to stop the advancing threadline, but a complex mechanical buffer system is required to do so.

German Published Patent Application No. 33 36 202 discloses a device for interlacing filament yarns with an air splicer without interrupting yarn transport. This process, however, is limited to uncoalesced multifilament threadlines.

There exists a need for a simple, versatile, and reliable apparatus and method for splicing a moving threadline to another threadline, especially for spandex.

SUMMARY OF THE INVENTION

The apparatus of the present invention for splicing a moving first threadline to a second threadline comprises:

means for guiding the first threadline into alignment with the second threadline being aligned with the guiding means of the first threadline by an alignment means and being held substantially stationary by a holding means;

first and second rotatable adhesive tape applicators located so that the first and second threadlines are between the applicators and when the applicators are rotated, adhesive splice tape on a surface of the first applicator is urged against the threadlines and against adhesive splice tape on a surface of the second applicator to form a splice; and means for parting the first threadline between the splice and a source of the first threadline.

The process of the present invention for splicing a moving first threadline to a second threadline, comprises the steps of:

(a) guiding a first threadline into alignment with a second threadline;

(b) holding the second threadline substantially stationary in alignment with a guiding means for the first threadline;

(c) applying adhesive splice tape to the first and second threadlines to form a splice;

(d) releasing the second threadline; and (e) parting the first threadline between the splice and a source of the first threadline.

DETAILED DESCRIPTION OF THE INVENTION

As used herein, "threadline" means any form of fiber which is substantially continuous, such as monofilaments, spun staple yarns, continuous multifilaments, continuous coalesced multifilaments, and the like. The substance from which the fiber can be formed can be synthetic or natural. Among the synthetic substances are included polyurethanes and polyurethaneureas, such as spandex; polyetheresters; polyamides, such as nylon 6 and nylon 66; aramides; and polyesters, such as polyethylene terephthalate, polypropylene terephthalate, and polybutylene terephthalate. Among the natural substances are included cotton, wool, hemp and flax.

Figure 1:
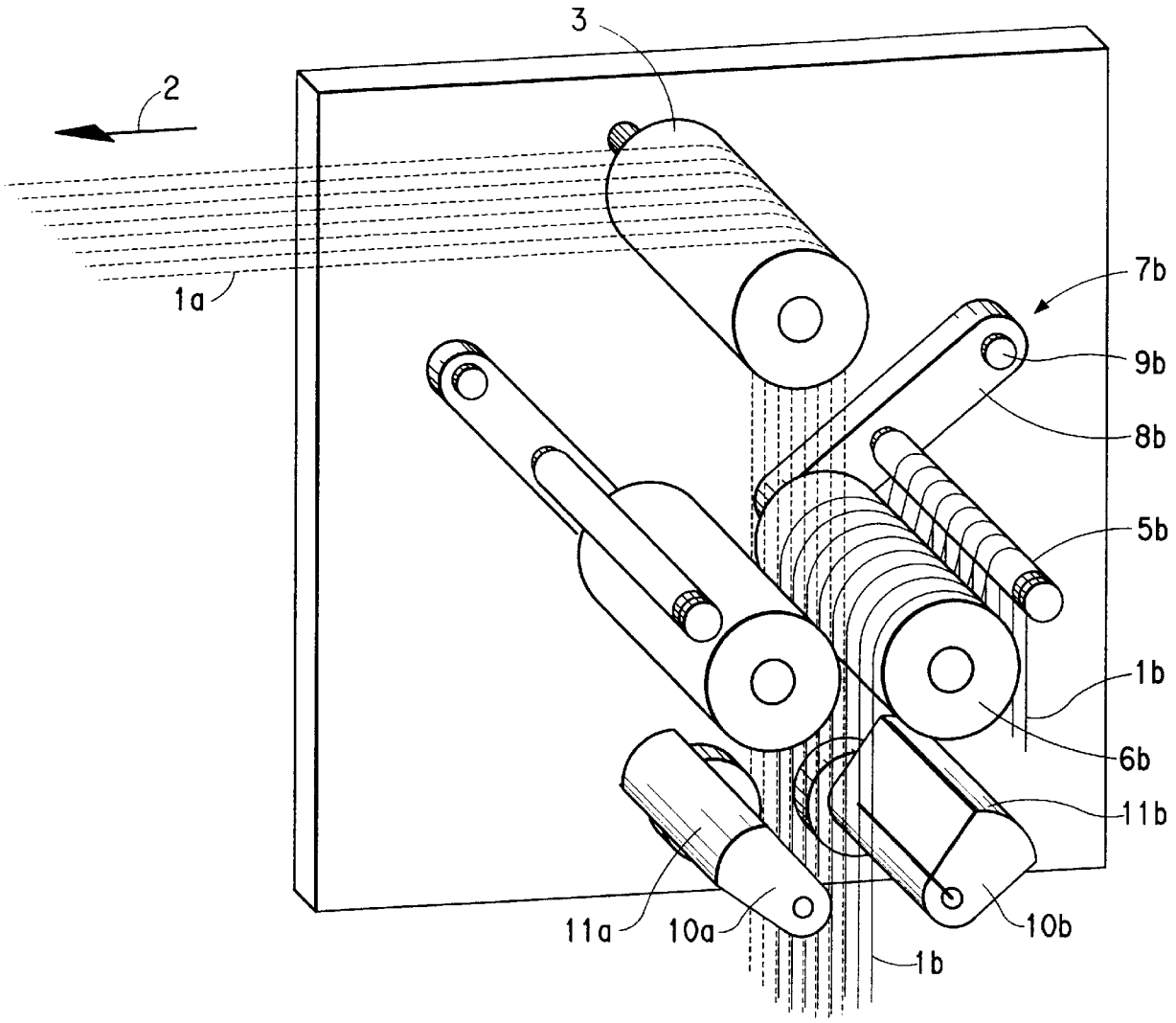
FIG. 1 is an isometric view of the preferred embodiment of the splicing apparatus of this invention.

Turning first to FIG. 1, a preferred embodiment of the apparatus is illustrated as it would appear for splicing a first set of up to eight threadlines 1*a* to a second set of up to eight threadlines 1*b*.

Figure 2B:
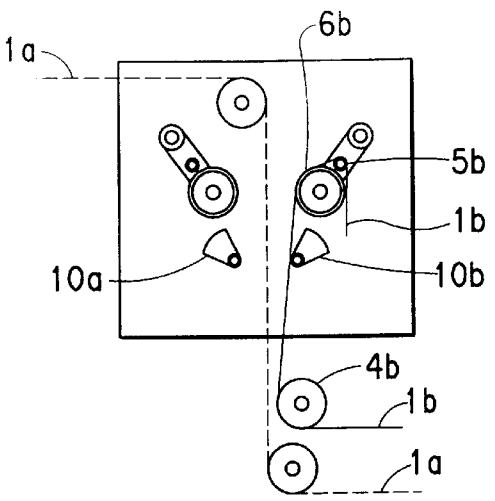
FIG. 2 is a schematic illustration of the preferred apparatus, showing its preparation for splicing and its operation in (a) through (e) and its preparation in (f) for a subsequent splice.

Threadlines 1*a* are moving in the direction of arrow 2 over exit idler roll 3 (a roll that can freely rotate and is not driven), being pulled through the splicing apparatus by the downstream process equipment that is using the fiber. The threadlines are fed by feed idler roll 4*a* (a roll that can freely rotate and is not driven) (see briefly FIG. 2*a*). Threadlines 1*b* are substantially stationary, being held in thread holder 5*b* after passing over feed idler roll 4*b* (see briefly FIG. 2*b*) and an alignment device such as an idler roll 6*b*. The means of holding the threadline can be a spring, adhesive, a clamp, or other suitable means. A spring is preferred. Preferably, alignment assembly 7*b* is used to align the threadlines adjacent to each other. This assembly can comprise a thread holder and alignment idler roll, which are mounted on arm 8*b* which can pivot about pivot point 9*b* or can remain stationary. Stationary guides can be used in place of the feed, alignment, and exit idler rolls, but rolls are preferred. Rotatable adhesive tape applicators 10*a* and 10*b* are shown in standby position.

It is preferred that the rolls be grooved, the number of grooves being equal to the number of threadlines being spliced. This improves alignment of the threadlines for better splicing.

The apparatus of the invention can accommodate eight threadlines or can splice fewer or more than eight threadlines, provided each of the components which come into contact with the threadlines are adapted to accommodate, pair-wise, the appropriate number of threadlines. Such adaptation means that each such component is made of the appropriate width to accommodate the threadlines and, preferably, in the case of the rolls, that there is a groove for each threadline.

Figure 2C:
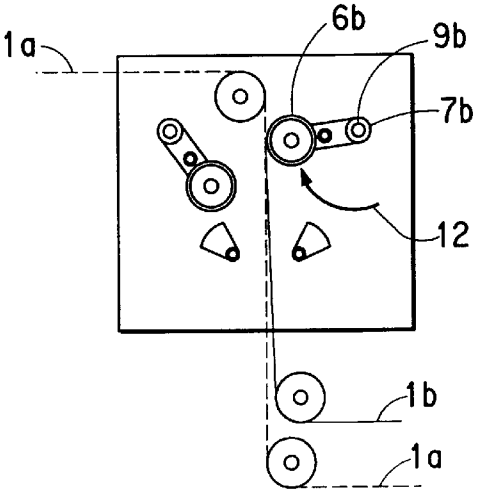
Figure 2A:
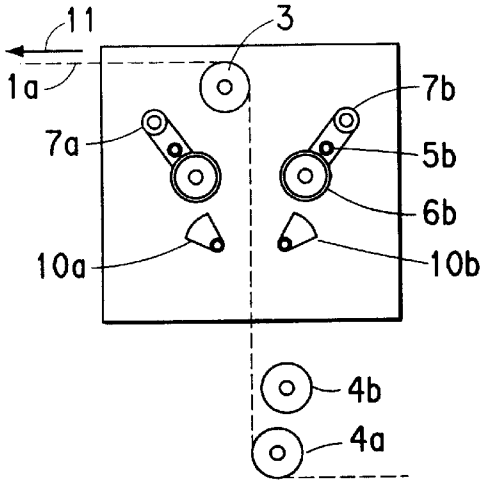
Figure 2E:
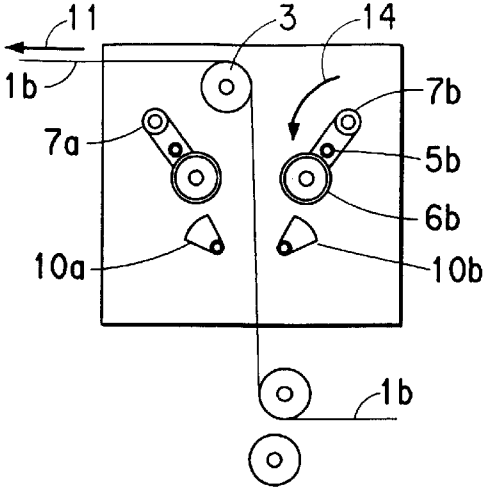
Figure 2F:
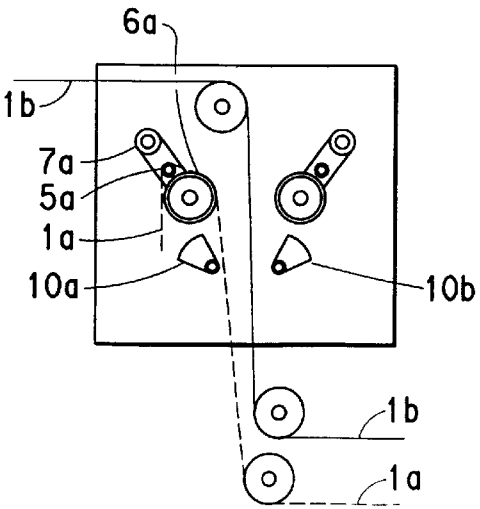
Figure 2D:
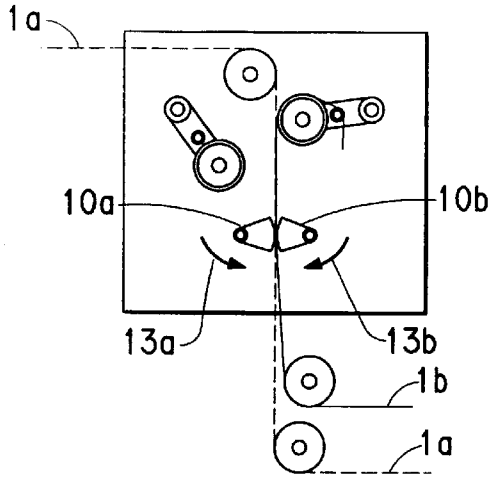

The alignment assembly can (optionally) pivot, as shown in FIGS. 2*c* and 2*d* in order to aid in the alignment of the moving and stationary threadlines. This is done just prior to splicing.

Returning to FIG. 1, it is preferred that tape applicator surfaces 11*a* and 11*b* be compliant and convex, for example, semi-circular. They can be provided with an elastomeric contact surface (e.g., rubber), so that adhesive tape (not shown) applied to the surface of one applicator makes good contact with the threadlines and the tape on the surface of the other applicator when the applicators are rotated toward each other. It is preferred that the tape applicators be counter-rotating.

It is preferred that the release tape applied to surfaces 11*a* and 11*b* be an asymmetric double-sided tape. By "asymmetric" it is meant that the adhesive characteristics of the two sides of the tape are different. The side that contacts the applicator surface is strongly adherent so that it remains on the applicator surface during splicing. The other side of the tape is weakly adherent. This tape stays on the applicator throughout the splicing process. A second asymmetrical tape (or a series of tape strips) (splice tape) is placed on the release tape (which is on the applicators), such that it is in alignment with the threadlines. The splice tape has no adhesive on the .side that is in contact with the release tape. The adhesive side of the splice tape is strongly adherent to the threadlines and also to itself so that when the applicators press against each other and the threadlines, the splice so formed is secure. The splice tape goes with the threadlines once the splice is performed. The release tape remains on the applicator and is changed on a predetermined frequency. After the splice tape has been mounted on the applicator surface, a temporary cover tape can optionally be applied to the exposed surface of the splice tape in order to protect the exposed adhesive surface from dirt. The protective cover is removed before splicing is initiated. Alternatively, the splice tape can be held to the applicator surface by other means such as vacuum, pins, or any other suitable mechanical device.

Parting of the threadlines, that is, cutting or breaking them between their source and where the splice is made to the second threadline, can be accomplished by knives, shears, hot wire cutters and the like. Clamps can also be used to hold threadlines under tension (from the pull of the downstream equipment) until they break. Knives are preferred. For example, a pair of knives (not shown) can be located just below the tape applicators, one knife on each side of the pair of threadlines. A two-sided cutting board (not shown), oriented vertically, can be located between threadlines 1*a* and 1*b* so that threadline 1*a* passes between one knife and the board, and threadline 1*b* passes between the other knife and the board. The knives can be spring loaded, so that the selected threadlines are parted between the knife blade and the board when the selected knife is released. The proper knife can be released electronically by a timing signal from the rotary tape applicators.

Certain auxiliary components and equipment are often used with the splicing apparatus of this invention. These include detectors for broken ends of thread-lines and threadline sources such as unwinders or creels. The unwinder can be driven for rolling takeoff from the fiber packages or bobbins, or it can be passive, for over-end takeoff. If rolling takeoff is desired, the unwinder drives can be coordinated with the actions of the splicer for trouble-free splicing, as will be described below.

Further advantages can be attained by splicing fewer than all the threadlines at one time. To splice preselected, individual threadlines, each threadline is provided with its own parting means instead of a single parting means for all threadlines. When the parting means is a knife-and-cutting board combination, only one cutting board is needed even when a plurality of knives is used. It is unnecessary to modify the rolls, alignment assemblies or tape applicators for individual splicing. These can be activated as if all the threadlines were being spliced, without significantly affecting the operation of the apparatus.

When the package unwinder is a rolling takeoff, it can be modified so that each package can be driven separately for individual threadline control. For example, the unwinder can have a common drive shaft with a belt-driven clutch for each package position. The combination of individual threadline splicing with electronic package size sensing is particularly advantageous, because a plurality of threadlines can be continuously and reliably supplied to a downstream apparatus, as is described below.

For sake of convenience, the operation of a preferred embodiment of the apparatus of the present invention will now be described with reference to FIG. 2 in terms of a moving threadline and a substantially stationary threadline, but the operation can be applied to any number of threadlines.

As shown in FIG. 2(*a*), moving threadline 1*a* is being taken from an unwinder or creel (not shown) and directed by feed idler roll 4*a* and exit idler roll 3 between tape applicators 10 and alignment assemblies 7*a* and 7*b*. The downstream process using the threadline is pulling it in the direction shown by arrow 11.

Turning now to FIG. 2(*b*), in preparation for splicing, threadline 1*b* is passed around feed idler roll 4*b* and alignment idler roll 6*b*. Threadline 1*b* is inserted into spring holder 5*b*. Release and splice tapes (not shown) are applied to convex compliant surfaces of tape applicators 10*a* and 10*b*.

When splicing is initiated, alignment assembly 7*b* optionally pivots around point 9*b* in the direction shown by arrow 12 in FIG. 2(*c*), thus urging threadline 1*b* against threadline 1*a*.

In FIG. 2(*d*), tape applicators 10*a* and 10*b* are shown counter-rotating toward each other, preferably in the direction shown by arrows 13*a* and 13*b*. Applicator 10*a* is rotating counter-clockwise, and applicator 10*b* is rotating clockwise, so that applicator surfaces 11*a* and 11*b* (see briefly FIG. 1) are moving in the same general direction as the moving threadline. The applicators are shown at the moment of closest contact, as the tapes are being pressed against each other and against threadlines 1*a* and 1*b*. At this point in the splicing sequence, the following events can occur in rapid succession or substantially simultaneously: the drive feeding threadline 1*b* (if the threadline source is driven and not passive) can be activated, the tape applicators can rotate, a cutter (not shown) can be activated to part threadline 1*a* between its source and the splice being formed, and the unwinder drive for threadline 1*a* can be deactivated.

Turning now to FIG. 2(*e*), as threadline 1*b* begins to move (arrow 11) toward the downstream equipment that is utilizing it, it is released from spring holder 5*b* by the applied tension, applicators 10 continue counter-rotating until they arrive once again at standby position, and alignment assembly 7*b* returns (arrow 14) to standby position.

As shown in FIG. 2(*f*), in preparation for the next splice, threadline 1*a* has been passed around feed idler roll 4*a* and alignment idler roll 6*a* and inserted it into spring holder 5*a*. Release and splice tapes (not shown) are applied to convex compliant surfaces of tape applicators 10*a* and 10*b*. Thus FIG. 2(*f*) corresponds to FIG. 2(*b*), but with threadline 1*b* moving and threadline 1*a* substantially stationary, so that the roles of first and second threadline are reversed.

The alignment assemblies, applicators, knives, and unwinder (if driven for rolling takeoff) can be activated by any suitable means such as timers, solenoids, and stepper motors with adjustable timings.

When a plurality of threadlines are passed through the splicer but not all threadlines are to be spliced, the threadline (s) are passed over the rolls to the appropriate slot(s) on the spring thread holder. In such a situation each of the threadline(s) to be spliced can have its own cutter and only the preselected cutters that correspond to the threadline(s) to be spliced are activated. The splicer is then operated as described above.

Utilizing electronic sensing equipment with the process of this invention for the splicing of individual threadlines permits truly continuous use of a plurality of threadlines with substantially no waste left on the packages. As each package nears its end, package size is detected and signaled to the splicer. The apparatus of this invention can then splice the individual threadline, resulting in a process where downtime of downstream operations is minimized due to continuous running of threadlines.

We claim:

1. An apparatus for splicing a moving first threadline to a second threadline, comprising:

means for guiding the first threadline into alignment with the second threadline being aligned with the guiding means of the first threadline by an alignment means and being held substantially stationary by a holding means;

first and second rotatable adhesive tape applicators located so that the first and second threadlines are between the applicators and when the applicators are rotated, adhesive splice tape on a surface of the first applicator is urged against the threadlines and against adhesive splice tape on a surface of the second applicator to form a splice; and means for parting the first threadline between the splice and a source of the first threadline.

2. The apparatus of claim 1 wherein the guiding means is an idler exit roll and an idler feed roll.

3. The apparatus of claim 2 wherein:

the rolls are grooved;

the holding means is a spring;

the applicator surfaces are convex and compliant;

the applicators counter-rotate so that when the surfaces are in contact with the threadlines and each other, the surfaces are moving in the same general direction as the first threadline; and the parting means is a knife.

4. The apparatus of claim 3 wherein each of the feed rolls, alignment rolls, exit roll, applicators, and the knife parting means are adapted to splice, pair-wise, a plurality of first threadlines to a plurality of second threadlines.

5. The apparatus of claim 4 wherein the parting means comprises a plurality of knives corresponding to the plurality of first and second threadlines, the plurality of knives being individually activatable for cutting preselected first threadlines.

6. A method for splicing a moving first threadline to a second threadline, comprising the steps of:

(a) guiding a first threadline into alignment with a second threadline;

(b) holding the second threadline substantially stationary in alignment with a guiding means for the first threadline;

(c) applying adhesive splice tape to the first and second threadlines to form a splice;

(d) releasing the second threadline; and (e) parting the first threadline between the splice and a source of the first threadline.

* * * * *